United States Patent [19]

Mattox

[11] Patent Number: 4,505,474

[45] Date of Patent: Mar. 19, 1985

[54] WEIGHTED ELASTOMERIC JUMPING DEVICE

[76] Inventor: Ernest M. Mattox, 1683 Leonard, NW., Grand Rapids, Mich. 49504

[21] Appl. No.: 614,329

[22] Filed: May 25, 1984

[51] Int. Cl.[3] ..... A63B 5/20

[52] U.S. Cl. ..... 272/75; 272/117; 272/128

[58] Field of Search ..... 272/75, 74, 128, 117; 446/236

[56] References Cited

U.S. PATENT DOCUMENTS 1,817,616 8/1931 Goff ..... 272/75
3,762,704 10/1973 Gingras ..... 272/75
4,109,906 8/1978 Wilson ..... 272/142 X
4,177,985 12/1979 Hlasnicek ..... 272/75

*Primary Examiner*—Richard J. Apley
*Assistant Examiner*—Kathleen D'Arrigo
*Attorney, Agent, or Firm*—Price, Heneveld, Huizenga & Cooper

[57] ABSTRACT

An exercise device that includes a pair of handles joined by an elongated flexible tube. The flexible tube includes a weighting material and the tube is formed from a longitudinally resilient elastomeric material so that as the exercise device is turned about a person, a variable moment arm is produced between the center of gravity of the weighting material and the handles.

18 Claims, 7 Drawing Figures

WEIGHTED ELASTOMERIC JUMPING DEVICE

BACKGROUND OF THE INVENTION

The present invention relates to exercise devices and in particular to cardiovascular conditioning exercise devices, such as jump ropes.

A wide variety of exercise programs are used to condition various different aspects of the human body. One type or "class" of exercise program involve weight training, weight lifting or other physical exercises that are directed to the development of the muscles or the strength of the participant. Typically, such programs involve physical exertion by the participant in order to work and fatigue certain muscle groups. Weight training and the like operate very effectively in order to produce such "strength" conditioning.

Although "strength" exercise programs, such as weight training, do result to some degree in an increase in blood circulation, such programs are minimally effective in conditioning the circulatory or respiratory systems. Normally, exercise programs directed to cardiovascular conditioning are structured quite differently from those designed for such "strength" conditioning. Cardiovascular exercise programs typically are made up of exercises that involve a high degree of movement, these exercises being performed quickly and repeated many times without interruption. The constant activity causes an increase in blood circulation and respiration. For example, aerobic dance, long distance running, cross country skiing and various other competitive sports involve such cardiovascular conditioning.

One problem associated with conventional exercise programs is that the exercises which are targeted towards "strength" building often do not produce adequate cardiovascular conditioning. The reverse situation also occurs with many exercises that are targeted toward cardiovascular conditioning. Further, the strength conditioning that is provided by most cardiovascular conditioning is usually limited to certain areas of the body. For instance, although long distance running is an excellent cardiovascular conditioning exercise, any resulting "strength" conditioning is limited to the runner's legs. Long distance running produces limited "strength" conditioning of the runner's upper body. For this reason, in order to obtain a complete workout, athletes normally combine a series of strength building exercises, such as weightlifting, with a series of cardiovascular conditioning exercises, such as running or jumping rope.

Another problem associated with most cardiovascular conditioning exercises is that the beneficial effects are only produced after lengthy, uninterrupted repetitions of the exercise. Some theories maintain that what cardiovascular conditioning occurs is produced predominantely toward the end of the workout, rather than being experienced as a proportionate effect equally distributed throughout the exercise repetitions. For this reason, cardiovascular conditioning is normally both very time consuming and monotonous.

One such exercise that is primarily targeted at cardiovascular conditioning is jumping rope. If a proper jump rope regime is followed, excellent cardiovascular effects are produced. Further, boxers and the like have long used jump rope exercises in order to develop "foot quickness" and balance. Although an excellent exercise for these conditioning purposes, jump rope exercise suffers from the problems noted above in that its beneficial effects are only recognized after relatively lengthy periods of exercise. Additionally, any "strength" developing effects produced by jump rope exercises are confined almost exclusively to the practitioner's legs.

Due to the popularity of jump rope exercises some prior artisans have attempted to improve its overall conditioning effect. Heretofore jump ropes have been fitted with discrete external weights in an attempt to provide a wider spacing between the cord lengths depending from the user's hands. Others have used jump ropes that have an increased weight. Although such weighted ropes are in some aspects an improvement over standard jump ropes, such weighted ropes exhibit certain deficiencies. Most weighted jump ropes provide a substantial hazard to the user and surrounding persons. If the rope inadvertently strikes the user or another person, injury is likely since the weighted section is moving at a high rate of speed. Additionally, the continuous sriking of the floor by the weights or weighted section has a tendency to damage or undesirably wear the floor surface and/or the rope.

Another problem experienced with previous weighted jump ropes is an undesirable tugging or jolting that is imparted to the user's arms by the rope as it circles the user. It is hypothesized that this jolting effect is produced due to the combined centrifugal and gravitational forces acted upon the jump rope. As the rope passes through its circle of travel it shifts from a downward to an upward direction of movement. It is hypothesized that it is this continual transition between movement assisted by gravity and movement resisted by gravity that produces the jolting effect. Another possible reason for this undesirable jolting effect is that in prior jump ropes weighted with discrete or fixed weights the load upon the rope is reduced to essentially zero when the weight strikes and is supported by the floor. As the load is reapplied by the weight a jolt results. This effect is magnified by slack or sagging of the rope while the weight is supported by the floor. Whatever the reason for this jolting effect, it results in an uncomfortable shock being imparted to the arms of the exerciser.

SUMMARY OF THE INVENTION

The present invention resolves the problems noted above by the provision of an exercise device that combines both cardiovascular conditioning and strength development. An elongated elastomeric cord is weighted in order to provide stretching of the cord while the cord is being turned. In one preferred embodiment an elongated hollow cord of elastomeric material is at least partially filled with a particulate weighted material. The invention thus provides a jump rope-like exercise device that has a variable moment arm connected to a weighted section.

Various beneficial results are achieved by the exercise device. The exercise device produces both cardiovascular conditioning along with strength development while greatly reducing the period of time required for such cardiovascular conditioning to occur.

The exercise device is uncomplicated to use but will produce the proper conditioning effects without the uncomfortable exertion of forces upon the arms of the user.

The exercise device is one that is safe in operation and one that reduces the chances of injury if improperly operated.

The exercise device provides a higher heart rate in a shorter period of time than prior exercises, at least in part due to more portions of the body being worked than most prior exercises. It will be noted that the present invention allows a person to greatly reduce the number of different exercises he or she must perform in order to receive the same amount of conditioning. Also the person can greatly decrease the length of time necessary for the workout and still receive the same amount of overall conditioning. The practitioner can determine the length of time necessary to be devoted to the exercise in order to produce this overall effect, since the conditioning effect is related to the speed at which the practitioner exercises. Because of the relationship between the speed of the exercise and the exertion required, a person may begin his or her physical conditioning program using this device and continue using the same device as his or her physical condition improves.

It will also be noted that the exercise device includes elastomeric cushioning material on the moving portion. This elastomeric cushion helps to prevent injury should the exercise device accidentally strike either the practitioner or others. This elastomeric cushion also covers the portion of the exercise device which strikes the floor and therefore prevents damage to the floor surface, particularly when the device is used on hardwood gymnasium floors or cushioned floors that have a surface which is prone to rupture. Further, with the present device the "jolting" problem experienced with other jump ropes is alleviated.

DETAILED DESCRIPTION OF THE PREFERRED EMBODIMENTS

Figure 1:
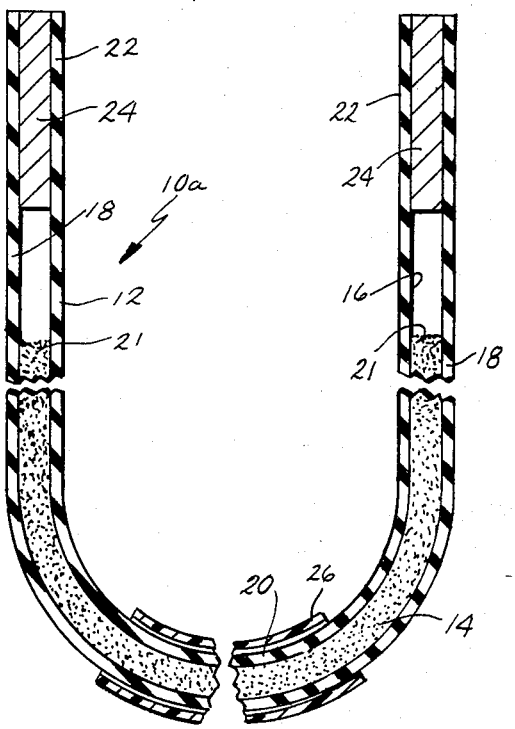
FIG. 1 is a fragmentary, sectional view of an exercise device embodying the present invention shown in a static condition.
Figure 3:
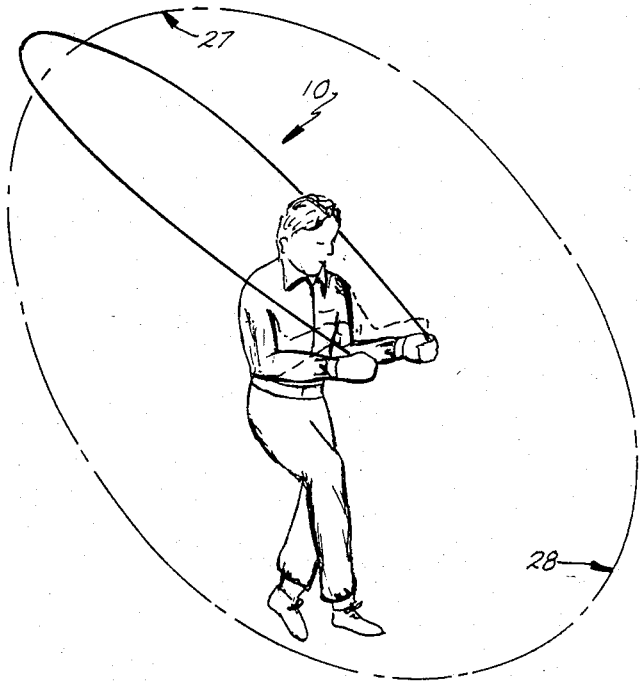
FIG. 3 is a schematic drawing of a person utilizing the exercise device of FIG. 1 and an approximation of the path of travel of the exercise device as it circumscribes the person using the device.

As shown in FIG. 1, an exercise device 10*a* includes an elastomeric, flexible member 12 that is partially filled with particulate weighting material 14 in order to produce a weighted, jump rope-like device. As shown in FIG. 3, during use elastomeric flexible cord 12 stretches and contracts as exercise device 10*a* pivots about the user's body, and thus provides a variable moment arm from the center of gravity of device 10*a*. The force generated by device 10*a* therefore varies with the turning speed and elongation of device 10*a*.

Figure 2:
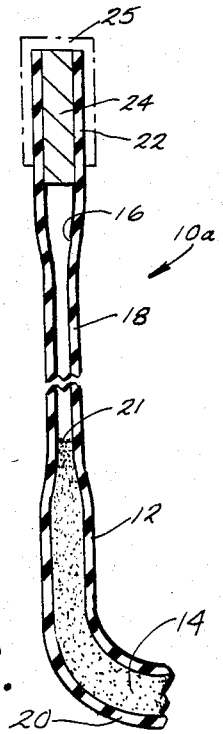
FIG. 2 is a fragmentary, sectional view of the exercise device of FIG. 1, shown in a dynamic, elongated condition.

In the first preferred embodiment shown in FIGS. 1 and 2, device 10*a* includes flexible member 12 that is an elongated, hollow cord or tubular element having an inner aperture or channel 16 that extends the entire length of flexible cord 12. Aperture 16 opens through either end of cord 12. Flexible cord 12 is made from an elastomeric material such that in addition to being readily bendable, flexible cord 12 will elongate when force is applied axially along its length.

Preferably, flexible cord 12 is a latex tubing having a wall thickness of approximately one-eighth inch. The latex material has a durometer hardness of thirty-five shore A scale within a tolerance of plus or minus five. The latex material has a maximum specific gravity of 0.97 and a minimum tensile strength of thirty-five hundred p.s.i. The latex material also preferably has a minimum percentage of elongation at break of seven hundred and fifty, and a modulus in pounds per square inch at one hundred percent that ranges between seventy and one hundred twenty-five p.s.i.

Preferably, in an exercise device 10*a* having flexible member 12 of the above material and which has been provided with weighting material 14 to an overall weight of six pounds, flexible member 12 has an outside diameter of one and one-quarter inch and an inside diameter of one inch. Such a device 10*a* has a length of eight feet, a wall thickness of one-eighth inch and flexible member 12 is filled with a weighting material 14 until a total weight of six pounds is produced. An eight foot long exercise device 10*a* weighing five pounds has a one and one-eighth inch outside diameter, a seven-eighth inch inside diameter and a wall thickness of one-eighth inch. An eight foot long exercise device 10*a* having a weight of three and one-half pounds has a one inch outside diameter, a three-eighth inch inside diameter and one-eighth inch wall thickness. An eight foot long exercise device 10*a* weighing two pounds has an outside diameter of three-eighths of an inch, an inside diameter of one-half inch and a one-eighth inch wall thickness.

A second preferred material for flexible cord 12 is synthetic polyisoprene compound also having a wall thickness of approximately one-eighth inch of the type distributed by Loran Manufacturing Company of New Philidelphia, Ohio. The polyisoprene material has a durometer hardness of forty. The polyisoprene material preferably has a percentage of elongation at break of nine hundred, and a modulus in pounds per square inch of approximately one hundred p.s.i. The physical dimensions for device 10*a* utilizing the polyisoprene material are approximately the same as those noted above for the device utilizing latex material.

As will be recognized, various other elastomeric materials may be used that elongate elastomericly a percentage of their length sufficient to produce the variable moment arm effect or the cushioning effect noted below.

Channel 16 is substantially filled with particulate weighting material 14 in order to produce the preselected total weight required. Preferably particulate matter 14 has a very small grain size and is self-lubricating in order to prevent blockages from forming within cord 12. Such blockages prevent the shifting of weighting material 14 within cord 12 or the reduction in diameter of cord 12, as explained below. A silica sand is the preferred weighting material, although weighting material having a larger particulate grain size may alternatively be used. A drying agent or dessicant may be added to weighting material 14 to reduce any adhesion or clumping that may result in some particulate materials. In exercise devices 10*a* making use of a larger grained weighting material 14, such as buckshot or BB's, a lubricating agent such as graphite or a light viscosity oil may be placed within aperture 16 in order to prevent blockages from forming. When in a position of use as shown in FIG. 1, cord 12 is held in U-shaped configuration, having two depending legs or depending elastomeric regions 18 and a joining section 20. Weighting material 14 completely fills joining section 20 and extends up depending legs 18. Particulate material 14 does not completely fill cord 12 so that an upper level 20 is recessed somewhat from the ends of cord 12.

On either end of flexible cord 12 is a handle 22, FIGS. 1 and 2. A cylindrical wooden dowel 24 is forced down into aperture 16 at either end of cord 12 to form handles 22. The elastomeric properties of cord 12 cause dowels 24 to be gripped within the ends of cord 12. Dowels 24 form plugs that prevent the escape of particulate matter 14 or any lubricating agent which may be carried within aperture 16. Since cord 12 encompasses dowels 24, handles 22 form a compressible cushion that provides device 10*a* with good hand feel and also prevent handles 22 from slipping from the user's hands.

Alternatively each dowel 24 is made from a plug of rubber or polymeric material that flexes with the bending of cord 12. As shown in phantom in FIG. 2, a cap 25 is fitted over the end of cord 12 to provide an additional gripping surface to handle 22. Plug 24 depends past the lower end of cap 25 so that a user's hand is spaced from the interface between handle 22 and the remainder of cord 12. As device 10*a* is turned cord 12 curves smoothly into plug 24 which also curves. This smooth curve reduces wear between cord 12 and plug 24. Since caps 25 are spaced from the lower ends of plugs 24, the user's hands will not be rubbed by the curved portion of cord 12 or handle 22. Plugs 24 may be secured with a conventional adhesive if desired.

Alternatively, each dowel 24 may include a rounded lower end that provides a bearing surface that reduces scoring or damage to the inside of cord 12, as explained below in relation to the embodiment of FIG. 4.

Shown in FIG. 1 is a wear sleeve 26 that is carried on joining section 20. Sleeve 26 is a rubber or polymeric tubular sleeve that has an inside diameter greater than the outside diameter of cord 12. This permits sleeve 26 to rotate relatively freely about cord 12. Alternatively sleeve 26 may be made from self-lubricating polymeric material or coated internally with a conventional dry lubricating agent to reduce the friction between sleeve 26 and cord 12. Sleeve 26 reduces wear to cord 12 or the floor surface that would otherwise be produced by cord 12 striking the floor.

In use, a person rotates exercise device 10*a* and jumps over joining section 20 in normal jump rope-like fashion. When static, device 10 is in a non-elongated condition, shown in FIG. 1. As the user pivots the device about his body centrifugal forces are generated that act upon weighting material 14. As shown in FIG. 2, these centrifugal forces cause flexible cord 12 to elongate as weighting material 14 is forced outward from handles 22. As flexible cord 12 stretches, the diameter of cord 12 is reduced in the stretched area, or cord 12 "necks" down due to the stretching. Since weighting material 14 is not binding it is permitted to shift along the length of cord 12 as the diameter of cord 12 is reduced and aperture 16 becomes more restricted. Upper level 21 of the weighting material thus recedes from handles 22 as cord 12 stretches. The stretching of cord 12 and shifting of weighting material 14 causes the center of gravity of weighting material 14 to shift further away from handles 22.

The majority of the elongation of cord 12 occurs in depending legs 18, with the stretch being greatest proximate handles 22 and gradually being reduced down toward joining section 20. Although joining section 20 does not elongate to the degree that depending legs 18 elongate, weighting material 14 causes joining section 20 to remain bowed or rounded and therefore produces a desirable separation of depending legs 18. This tendency of joining section 20 to separate depending legs 18 makes it easier for a novice to use device 10*a* without becoming entangled in cord 12. Since device 10*a* elongates, a single length of device 10*a* will accommodate users having a wider range of heights than a conventional jump rope. Further, since section 20 does not stretch to the degree of depending legs 18, the elastomeric material of joining section 20 retains its resilient properties when in use. The elastomeric material of cord 12 therefore provides a thick spongy cushion or cushioning means enveloping or located around weighting material at joining section 20 which reduces the chances of injury in the event that device 10*a* inadvertently strikes another person or object. Since weighting material 14 shifts within cord 12, weighting material 14 will shift away from any point of impact to further reduce chances of injury. This cushioning effect also reduces scarring or damage to the floor surface on which the device is being used. Damage to the floor surface is further reduced by sleeve 26 which surrounds that portion of cord 12 which strikes the floor. As sleeve 26 strikes the floor and continues along its travel under the user, sleeve 26 rotates around cord 12. Sleeve 26 therefore acts as a wheel to roll cord 12 across the floor rather than cord 12 being simply dragged over the floor surface.

When a person turns device 10*a*, device 10*a* initially is in a non-elongated state. As the person increases the rate of turning, device 10*a* undergoes a transition from the non-elongated condition to the elongated or stretched condition until the targeted steady state turning rate is reached. Since the force exerted on the hands of the user is related to the elongation of device 10*a* as described below, device 10*a* provides a variable resistance or force during this transition phase and the initial turning force is not the same as the average exercise turning force. When device 10*a* is used the turning rate or r.p.m. is normally substantially reduced relative to the normal r.p.m. of a conventional jump rope, and this reduction in turning r.p.m. of device 10*a* is often in excess of thirty percent. Ordinarily, when a person uses the device at a high rate of speed, his or her arms and shoulders will be worked pivotally upwardly as shown in FIG. 3.

When device 10*a* is turned about a user at a rate of one hundred revolutions per minute, each side of device 10*a* elongates in a preferred range between approximately twenty-five and and forty-five percent, depending upon the weight of device 10*a* used. Although specific examples of preferred percentages of elongation at one hundred r.p.m. were approximately measured to be about twenty-nine percent, thirty-seven percent and forty-four percent, the percentage of elongation may be alternatively changed to lower or higher values outside of the preferred range.

Figure 6:
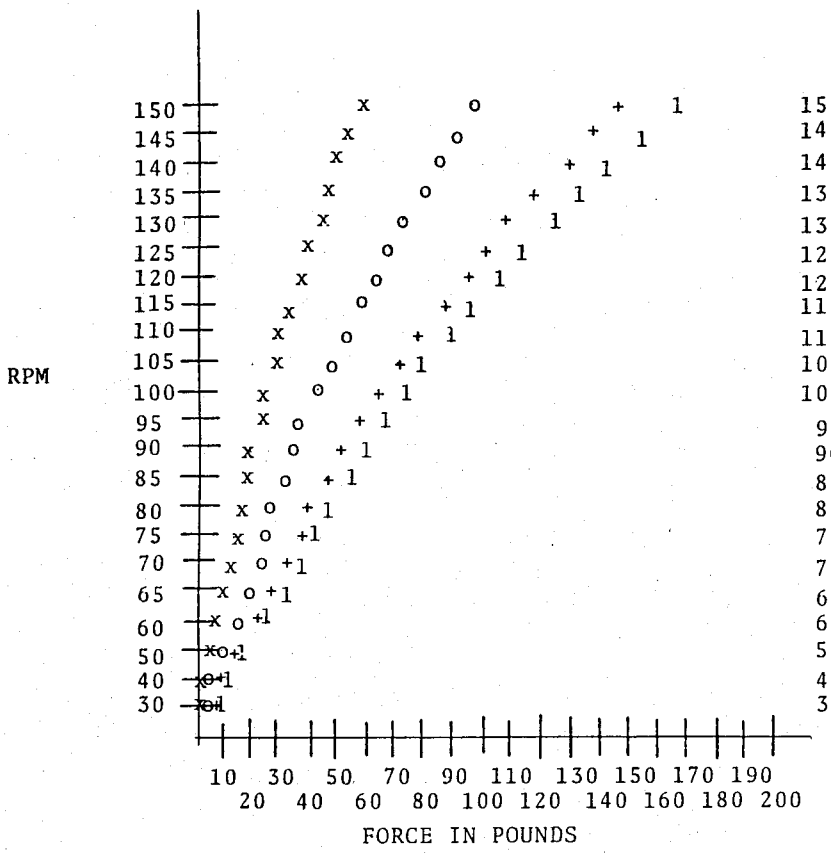
FIG. 6 is a graph plotting theoretically computed pounds of force versus turning r.p.m. produced by an exercise device having a flexible cord that is not elastomerically resilient.

As a person uses device 10a, the force exerted upon the user's hands and thus the amount of effort the user must exert is related to the speed at which device 10a is turned. FIG. 6 represents a theoretical calculation of the force in pounds produced by a jump rope that does not elongate versus the turning revolution per minute (RPM) of the jump rope. Shown in FIG. 6 is the force versus RPM plot for four ropes having different weights. "X" represents a two pound rope; "O" represents a three and one-half pound rope; "+" represents a five pound rope; and "1" represents a six pound rope. The vaules for FIG. 6 were calculated using the equation:

$$F = W_r C.$$

Where F is the force in pounds produced, W is the weight of the rope in pounds, r is the radius of the circle circumscribed by the rope, and C is a value calculated using the particular RPM of the rope. C is calculated by the equation:

$$C = (2.84 \times 10^{-5})(\text{RPM})^2.$$

The value $2.84 \times 10^{-5}$ is a centrifugal constant as reported in Machinery's Handbook (20th Ed.) pg. 338. Chart 1 represents the raw data compiled in FIG. 6.

CHART 1

| | FORCE IN POUNDS | | | |
|---|---|---|---|---|
| RPM | 2 Pound Rope | 3½ Pound Rope | 5 Pound Rope | 6 Pound Rope |
| 30 | 2.148 | 3.759 | 5.370 | 6.445 |
| 40 | 3.819 | 6.683 | 10.230 | 11.457 |
| 50 | 5.968 | 10.443 | 16.065 | 17.902 |
| 60 | 8.593 | 15.038 | 23.018 | 25.778 |
| 65 | 10.085 | 17.649 | 27.014 | 30.255 |
| 70 | 11.696 | 20.468 | 31.329 | 35.088 |
| 75 | 13.427 | 23.496 | 35.964 | 40.274 |
| 80 | 15.276 | 26.733 | 38.191 | 45.828 |
| 85 | 17.245 | 30.179 | 46.193 | 51.735 |
| 90 | 19.334 | 33.835 | 51.788 | 58.002 |
| 95 | 21.542 | 37.698 | 57.701 | 64.625 |
| 100 | 23.869 | 41.772 | 63.936 | 71.608 |
| 105 | 26.316 | 46.052 | 70.488 | 78.946 |
| 110 | 28.882 | 50.543 | 77.361 | 86.645 |
| 115 | 31.567 | — | 84.555 | 94.701 |
| 120 | 34.374 | 60.154 | 92.072 | 103.120 |
| 125 | 37.296 | 65.268 | 99.900 | 111.888 |
| 130 | 40.339 | 70.594 | 108.051 | 121.017 |
| 135 | 43.502 | 76.128 | 116.523 | 130.505 |
| 140 | 46.784 | 81.872 | 125.313 | 140.135 |
| 145 | 50.185 | 87.824 | 134.424 | 150.554 |
| 150 | 53.706 | 93.986 | 143.856 | 161.118 |

Figure 7:
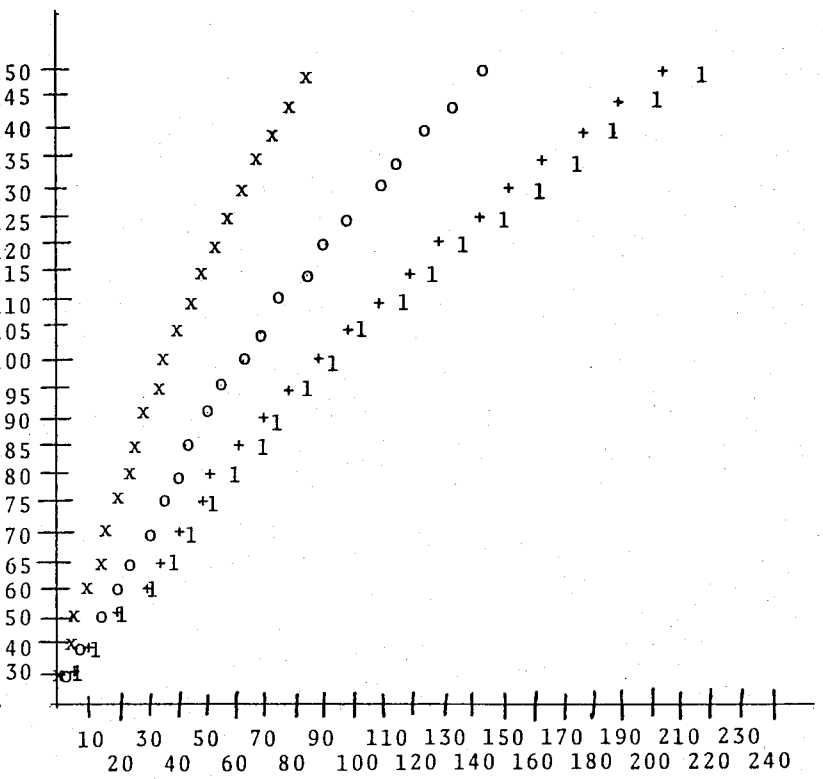
FIG. 7 is a graph plotting theoretically computed pounds of force versus turning r.p.m. produced by the exercise device of FIG. 1.

FIG. 7 represents a theoretical calculation of the force in pounds produced by device 10a versus the turning RPM of device 10a, for a device 10a manufactured from the above referenced polyisoprene material and according to the above dimensions for that material.

As in FIG. 6, "X" represents a two pound device 10a; "O" represents a three and one-half pound device 10a; "+" represents a five pound device 10a; and "1" represents a six pound device 10a. The values of FIG. 7 were calculated using the equation:

$$F = WrC\alpha.$$

Where each character represents the same variable described above, and $\alpha$ represents an elasticity constant reflecting the percentage of elongation of device 10a, when device 10a is subjected to a given force. $\alpha$ was determined for four devices 10a having weights of two, three and one-half, five and six pounds, each using the above polyisoprene cord 12. $\alpha$ was determined by suspending a fifty pound weight from a forty-eight inch length of device 10a and measuring the increase in length. Using devices of the above noted preferred materials, the two pound device 10a increased by twenty-nine inches producing a value of 1.60. The three and one-half pound device 10a increased by twenty-seven inches producing a value of 1.563. The five pound device 10a increased by twenty-one inches for a value of 1.438. The six pound device 10a increased by eighteen inches for a value of 1.375. Chart 2 represents the raw data compiled in FIG. 7.

CHART 2

| | FORCE IN POUNDS | | | |
|---|---|---|---|---|
| RPM | 2 Pound Device | 3½ Pound Device | 5 Pound Device | 6 Pound Device |
| 30 | 3.437 | 5.873 | 7.719 | 8.862 |
| 40 | 6.110 | 10.422 | 14.706 | 15.753 |
| 50 | 9.549 | 16.317 | 23.093 | 24.615 |
| 60 | 13.749 | 23.497 | 33.088 | 35.445 |
| 65 | 16.136 | 27.577 | 38.833 | 41.590 |
| 70 | 18.714 | 31.981 | 45.035 | 48.246 |
| 75 | 21.483 | 36.713 | 51.698 | 55.384 |
| 80 | 24.442 | 41.711 | 54.900 | 63.014 |
| 85 | 27.592 | 47.155 | 66.402 | 71.136 |
| 90 | 30.935 | 52.867 | 74.445 | 79.753 |
| 95 | 34.467 | 58.903 | 82.945 | 88.860 |
| 100 | 38.191 | 65.268 | 91.908 | 98.461 |
| 105 | 42.105 | 71.959 | 101.327 | 107.890 |
| 110 | 46.211 | 78.973 | 111.206 | 119.137 |
| 115 | 50.497 | — | 121.548 | 130.214 |
| 120 | 54.999 | 93.992 | 132.354 | 141.790 |
| 125 | 59.674 | 101.981 | 143.606 | 153.846 |
| 130 | 64.543 | 111.303 | 155.329 | 166.398 |
| 135 | 69.603 | 118.950 | 167.502 | 179.444 |
| 140 | 74.854 | 127.925 | 180.137 | 192.686 |
| 145 | 80.296 | 137.225 | 193.253 | 207.012 |
| 150 | 85.930 | 146.853 | 206.793 | 221.537 |

As noted from FIGS. 6 and 7, the force exerted by device 10a is increased due to the elongation of cord 12. This elongation increases nonlinearly with an increase in turning RPM, so that an increase in RPM will produce a disproportionately increased force upon the user's hands. Therefore, a person using device 10a may increase the effort required by an exercise program by changing either of two variables, either using a heavier device 10a or by increasing turning RPM.

The increased weight of device 10a provides device 10a with an increased momentum during use. After the turning pattern of device 10a is established, this momentum makes use of device 10a easier for novices to use than standard jump ropes. The user maintains the motion of device 10a by a more vertical movement of the forearms at the elbow with some shoulder pivoting, shown in phantom in FIG. 3, rather than a conventional circular motion. This effect is increased due to the "shock absorption" effect described below. Due to the elastic nature of cord 12, the twisting forces that are exerted on a person's hands are reduced without the use of a conventional swivel coupling on the handles, although such a swivel coupling could be provided. During use device 10a exercises the arms of the user as well as the user's legs.

As device 10a circumscribes the user, device 10a does not follow a circle in the manner of a standard jump rope. As shown in FIG. 3, the path followed by joining section 20 is oval shaped, with an enlarged extended region 27 behind the user and an enlarged extended region 28 in front of the user. Extended region 28 in front of the user is further removed from the user than extended region 27 to the rear. It is believed that the oblong configuration of this path of travel is produced by the combined effect of the centrifugal and the gravitational forces acting upon weighted joining section 20. Since device 10*a* is moving generally downward in front of the user, it is believed that the centrifugal and gravitational forces are additive and thus produce the larger extended region 28. Whatever the scientific explanation of this phenomenon may be, joining section 20 fluctuates between regions closer to the person and regions further removed from the person. As joining section 20 fluctuates between these various regions, elastomeric cord 12 resiliently varies in length and thus produces a "shock absorber" effect within device 10*a*. This shock absorber effect prevents undesirable jolting from being imparted to the user's hands and arms during such transitions. Further, since weighting material 14 is distributed through flexible member 12, device 10*a* is not completely unloaded when joining section 20 strikes the floor. Weighting material 14 extends up legs 18 to maintain a load on the device. Also, elongated legs 18 have a tendency to contract upon striking the floor, thus causing a spring force to be exerted by device 10*a* upon the user's hands. This contractive spring force is resisted by the weight of joining section 20 even though joining section 20 is supported by the floor surface.

Figure 4:
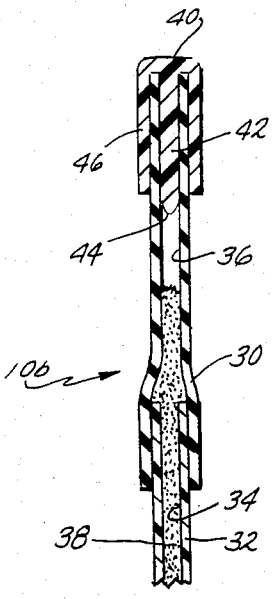
FIG. 4 is a fragmentary, sectional view of another exercise device that forms a second embodiment of the present invention shown in a static condition.

An alternative second preferred embodiment is shown in FIG. 4. An exercise device 10*b* includes two elongated, tubular flexible members 30 made of the elastomeric latex material described above. As both halves of exercise device 10*b* are identical, only one flexible member 30 is shown and described. Telescopingly received in the lower end of flexible member 30 is a substantially non-elastomeric flexible joining member 32. Joining member 32 forms a joining section with the elastomeric flexible member 30 of the other side. Due to the resilient properties of flexible member 30, joining section 32 is securely frictionally connected thereto. A conventional adhesive may also be used to join flexible member 30 to joining section 32. Joining section 32 includes an aperture or channel 34 which is communicative with an aperture or channel 36 in flexible member 30. Channel 34 is filled with particulate weighting material 38, preferably the silica material described above. Weighting material 38 fills joining section 32 and extends up into flexible members 30. On the upper end of flexible member 30 is a handle 40. Each handle 40 includes a center plug 42 that is received down into aperture 36 and which prevents the escape of particulate weighting material 38. Center plug 42 has a rounded end 44. Rounded end 44 permits flexible member 30 to pivot about center plug 42 without scoring or otherwise damaging the inside of flexible member 30. Connected to center plug 42 is a rounded cap 46 which extends about the exterior of flexible member 30 and includes a gripping surface thereon. Both joining section 32 and handles 40 are flexible in that they are readily bendable, but are preferably formed from a substantially non-elastomeric polymeric material.

In operation, exercise device 10*b* acts similar to exercise device 10*a* described above. However, since the predominate elongation of exercise device 10*a* is confined to depending legs 18 proximate handles 22, exercise device 10*b* only makes use of elastomeric material in the vicinity of handles 40. Therefore, flexible sections 30 are permitted to elongate while joining section 32 provides separation between flexible members 30.

Alternatively, a turn buckle or ball joint (not shown) may be included between the handle of the exercise device and the elastomeric flexible member. Additionally, various handles having conventional designs and means of securing to flexible member 30 are within the contemplation of the device.

Figure 5:
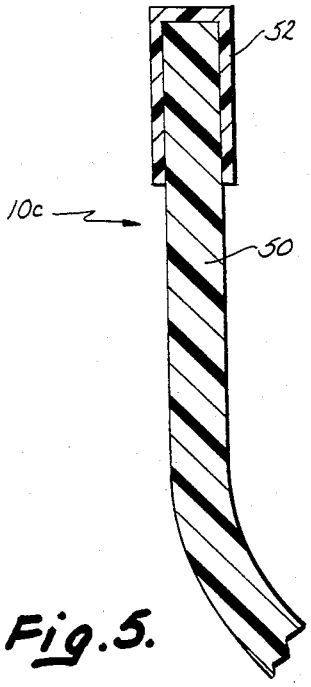
FIG. 5 is a fragmentary, sectional view of a third device that forms a third embodiment of the device shown in a static condition.

Shown in FIG. 5 is a third preferred embodiment referenced as device 10*c*. Device 10*c* has a flexible, elastomeric cord 50 that is made from expanded foam polymeric material. Cord 50 is a solid cord of material. The polymeric material of cord 50 is mixed with a weighing agent prior to expansion or foaming so that cord 50 results in an increased predetermined weight. Even though cord 50 is made of material having an increased weight, cord 50 is still provided with the ability to resiliently elongate during use. Device 10*c* therefore provides a moment arm between the user's hands and the center of gravity of device 10*c* that varies during use. On the upper end of cord 50 is a polymeric cap 52 that forms a handle for device 10*c*. Cap 52 has a suitable gripping surface, and due to the elastomeric properties of cord 50 good hand feel is provided by device 10*c*.

Exemplary of an expanded elastomeric material for cord 50 is polyisoprene having a blowing or expanding agent therein. One manufacturer of this polyisoprene material is Loran Manufacturing Company of New Philidelphia, Ohio. Examples of weighting agents to be used in cord 50 are lead or clay.

It is to be understood that the above is merely a description of the preferred embodiments and that various modifications or improvements may be made without departing from the spirit of the invention disclosed herein. The scope of the protection afforded is to be determined by the claims which follow and the breadth of interpretation which the law allows.

The embodiments of the invention in which an exclusive property or privilege is claimed are defined as follows:

1. An exercise device, comprising:

a pair of spaced handles;

an elongated, flexible cord joined to said handles, said flexible cord being resiliently elongatable at least in the regions adjacent said handles as said flexible cord is revolved around a person, said flexible cord comprising a hollow, resilient elastomeric cord extending between said handles;

a tubular sleeve received around at least a portion of said flexible cord, said sleeve being relatively freely rotatable about said flexible cord;

each said handle comprising a cylindrical plug received within and enveloped by one end of said elastomeric cord; and means for weighting said flexible cord, said weighting material being a granular material located within said flexible cord so as to be shiftable therein, whereby as said exercise device is revolved around a user said elongatable, flexible cord forms a variable moment arm between the center of gravity of said weighting means and said handles.

2. An exercise as defined in claim 1, wherein:

said elastomeric regions are made of latex material tubing.

3. An exercise device as defined in claim 1, wherein:

said elastomeric regions are made of polyisoprene material.

4. An exercise device, comprising:

a pair of spaced handles;

an elongated, flexible cord joined to said handles, said flexible cord being resiliently elongatable at least in the regions adjacent said handles as said flexible cord is revolved around a person, said flexible cord being made from a longitudinally resilient, elastomeric polymeric material at least in said regions adjacent said handles; and means for weighting said flexible cord, whereby as said exercise device is revolved around a user said elongatable, flexible cord form a variable moment arm between the center of gravity of said weighting means and said handles.

5. An exercise device as defined in claim 4, wherein:

said weighting means includes said flexible cord being made from an expanded foam polymeric material having weighting agents integrally mixed therein.

6. An exercise device, comprising:

a pair of spaced handles;

an elongated, hollow, flexible member having two ends, each said end secured to one of said handles;

a mass of particulate weighting material at least partially filling said flexible member, said weighting material having a specific weight greater than the specific weight of said flexible member; and said flexible member being elastomeric at least in the regions adjacent said handles, said elastomeric regions having a resiliency such that said weighting material causes said elastomeric regions to elongate as said flexible member is pivoted about a user, whereby said elastomeric regions form a variable moment arm between the center of gravity of said weighting material and said handle.

7. An exercise device as defined in claim 6, wherein:

the entire length of said flexible member between said handles is formed from a longitudinally resilient, elastomeric material.

8. An exercise device as defined in claim 7, wherein:

said handles comprise closure means for closing said ends, said closure means being received in said ends.

9. An exercise device as defined in claim 8, further comprising:

a flexible sleeve received around said flexible member so as to rotate relatively freely thereon.

10. An exercise device as defined in claim 9, wherein:

said weighting material is a self-lubricating sand-like granular material.

11. An exercise device as defined in claim 10, wherein:

said elastomeric material is made of a latex material tubing.

12. An exercise device as defined in claim 10, wherein:

said elastomeric material is made of a polyisoprene material tubing.

13. An exercise device as defined in claim 6, wherein:

said flexible member includes two elastomeric regions, said regions being joined by a joining section formed of flexible, longitudinally substantially non-resilient material.

14. An exercise device as defined in claim 13, wherein:

said handles comprise closure means for closing said ends, said closure means being received in said ends.

15. An exercise device as defined in claim 14, wherein:

said weighting material is a self-lubricating sand-like granular material.

16. An exercise device as defined in claim 6, wherein:

said flexible member includes means for cushioning said weighting material, said cushioning means enveloping said weighting material and said weighting material being shiftable therein, whereby said cushioning means forms a shock absorbing pad at the point of impact and said weighting material will shift away from the point of impact should said exercise device strike an object.

17. An exercise device as defined in claim 16, wherein:

said cushioning means includes said flexible member being made from an elastomeric cushioning material having a thickness of at least about one-eighth inch.

18. An exercise device, comprising:

a hollow, elongated flexible tube;

particulate weighting material slidably received within said flexible tube;

a handle secured to each end of said flexible tube;

means for closing each end of said flexible tube and for confining said particulate weighting material within said flexible tube; and said flexible tube being formed from a longitudinally resilient elastomeric material, whereby as said flexible tube is turned about a user said flexible tube elongates and said particulate weighting material shifts within said tube to provide a variable moment arm between the center of gravity of said weighting material and said handles.

* * * * *